US005915717A

United States Patent [19]

Faye

[11] Patent Number: 5,915,717

[45] Date of Patent: Jun. 29, 1999

[54] BOARD FOR SLIDING ON SNOW

[75] Inventor: Pierre Faye, Grenoble, France

[73] Assignee: Skis Rossignol S.A., Voiron, France

[21] Appl. No.: 08/744,379

[22] Filed: Nov. 7, 1996

[30] Foreign Application Priority Data

Nov. 10, 1995 [FR] France ..... 95 13568

[51] Int. Cl.[6] ..... A63C 5/04

[52] U.S. Cl. ..... 280/602; 280/609

[58] Field of Search ..... 280/602, 609, 280/610, 601

[56] References Cited

U.S. PATENT DOCUMENTS

| | | | |
|---|---|---|---|
| 3,801,116 | 4/1974 | Benner | 280/610 |
| 3,894,745 | 7/1975 | Heim et al. | 280/610 |
| 4,530,871 | 7/1985 | You | 280/610 |
| 5,344,177 | 9/1994 | Rousser et al. | 280/610 |
| 5,372,370 | 12/1994 | Rohrmosser | 280/610 |
| 5,560,632 | 10/1996 | Gauer | 280/609 |
| 5,687,983 | 11/1997 | Feketa et al. | 280/609 |
| 5,690,349 | 11/1997 | Rohrmoser | 280/610 |

FOREIGN PATENT DOCUMENTS

| | | |
|---|---|---|
| 0 182 776 | 5/1986 | European Pat. Off. . |
| 0 563 569 A1 | 10/1993 | European Pat. Off. . |
| 0 620 027 A1 | 10/1994 | European Pat. Off. . |
| A-109 654 | 6/1972 | France . |
| WO-A-93 16769 | 9/1993 | WIPO . |
| WO-A-95-00217 | 1/1995 | WIPO . |

*Primary Examiner*—Robert J. Oberleitner
*Assistant Examiner*—Bridget Avery
*Attorney, Agent, or Firm*—Oliff & Berridge PLC

[57] ABSTRACT

A board for sliding on snow has a body extending over the entire length of the board and forming a tip and a heel at the ends of the board and at least one upper plate that extends and rests on at least part of the board, except at the tip and the heel. The upper plate is rigidly attached to either a middle, front or rear zone of the body. The base of the upper plate and the corresponding upper surface of the body having matching shaped projections and indentations at a portion of the upper plate that is not rigidly attached to the body. The matching projections and indentations are designed to convert a lengthwise sliding movement of the upper plate on the body into a force that includes a pressure component that is perpendicular to the surface of the sole.

18 Claims, 4 Drawing Sheets

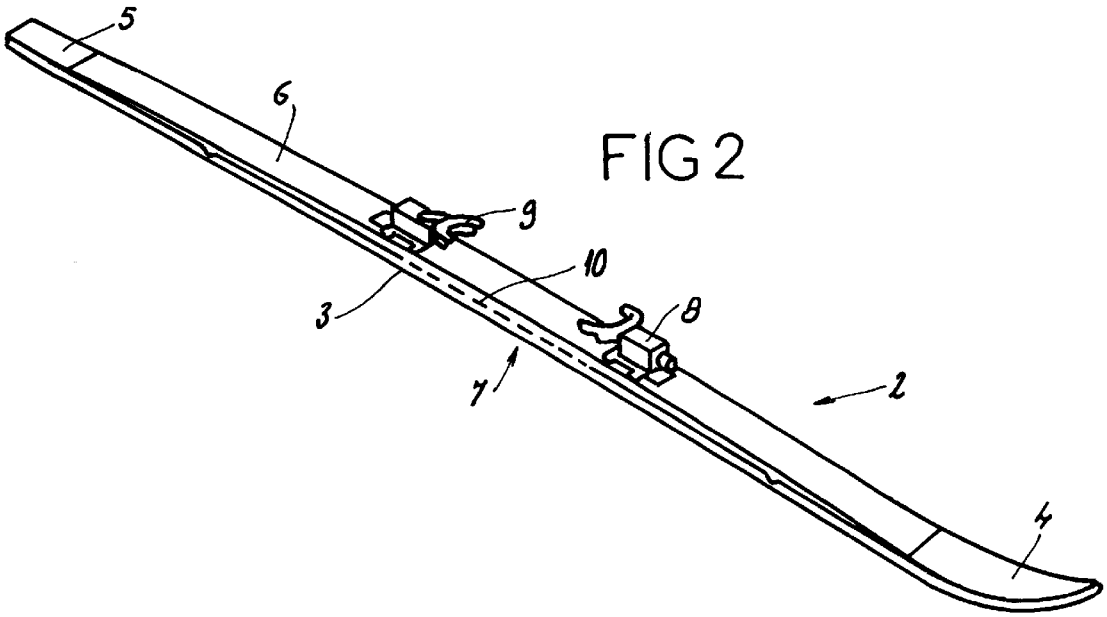
FIG 2
FIG 3
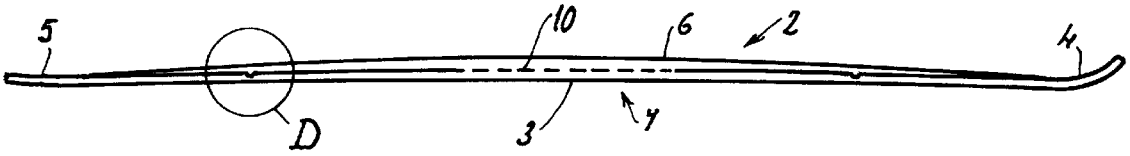
FIG4
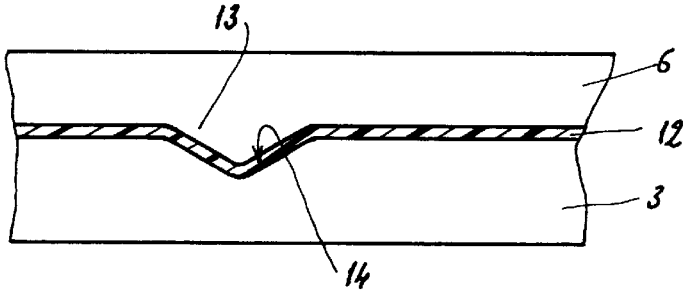
FIG5
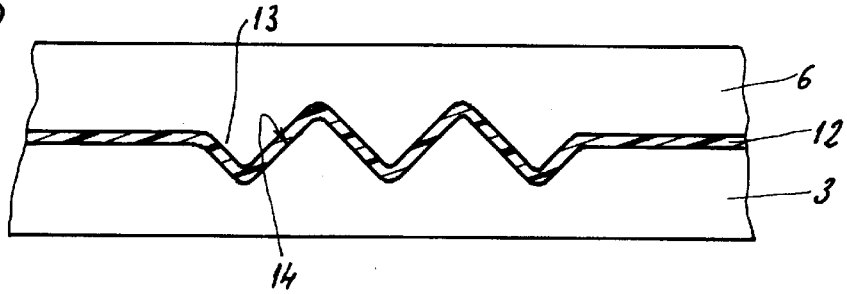

BOARD FOR SLIDING ON SNOW

BACKGROUND OF THE INVENTION

The present invention relates to a board for sliding on snow such as a ski, monoski, or surfboard.

A board for sliding on snow has a turned-up front end called the tip, a central part receiving the binding or bindings for the skier's boot or boots, called a skating zone, and a rear end called a heel.

The pressure applied by a board for sliding on snow, resulting from the weight of the skier, is not evenly applied to the snow from the tip to the heel. Thus, as shown in FIG. 1 of the attached schematic drawings, in which the position along the abscissa axis corresponds to the length of the board and the ordinate axis corresponds to the pressure of this board on the snow under the weight of the user, most of the pressure on the snow is exerted in the skating zone PA and some pressure is exerted in the tip zone S and the heel zone T. Between the tip and heel zones and the skating zone, there are two zones A and B in which the pressure is practically zero. However, it would be desirable to benefit from ski pressure on the snow that would be as even as possible over the length of the ski.

Document FR-A-2,670,392 relates to a ski having a lower part or base on which rests an upper part forming a stiffener, said stiffener being attachable in various ways to the base, and in particular attachable to the base in its middle part only, the interface between these two parts being relatively planar. The purpose of this structure is to adjust the rigidity of the ski according to the type of stiffener used, and to achieve damping by a shear effect at the ends of the stiffener because these ends are not rigidly attached to the base.

SUMMARY OF THE INVENTION

The goal of the invention is to supply a board for sliding on snow in which the distribution curve of the pressure exerted on the snow is as gradual as possible over at least part of the length of the board.

For this purpose, this board includes a body extending over the entire length of the board and forming, at the ends thereof, a tip and a heel. The body having a sliding sole bordered by lengthwise strips, a core, side walls, and at least one reinforcing element composed of at least one metal plate, a fabric layer or metal strips. The board also includes at least one upper plate which, extends over at least part of the board, except at the tip and the heel, and rests on the body. The plate is attached locally and rigidly to the body either in its middle part or in one of the front or rear end zones of the body. The base of the upper plate and the corresponding upper surface of body have, in at least one of the end zones of the upper plate not attached to the body, and on their faces that abut each other, matching shaped projecting and indented parts designed to convert a lengthwise sliding movement of the plate on the body into a force including a pressure component that is perpendicular to the surface of the sole.

When the board flexes, namely when it travels over hollows or bumps, or when it turns, the upper plate shifts relative to the body. In view of the rigid link between the upper plate and body that is located at a distance from at least one end of the plate, only the front and/or rear end or ends of the plate not linked to the body can move relative to said body. This movement of at least one of the ends of the upper plate relative to the upper surface of the body is used to improve the quality of contact between the board and the snow, by transformation of the forces resulting from the sliding movement of the plate on the body into a vertical pressure component of the board on the snow.

According to one embodiment of this board, the upper plate and the body have, in at least one of the end zones of the upper plate, opposite faces including matching imbricated notches in the shape of transverse bars/grooves or of fingers/depressions.

These notches can have various bar/groove shapes oriented transversely to the ski and have for example a sawtooth shape or a corrugated shape. It is possible to provide a single notch or several successive notches in each free end zone of the upper plate. The shapes of the notches influence the behavior of the board. If the notches are sawtooth-shaped, with steep slopes, the vertical pressure component of the board on the snow is greater than if the notches are composed of corrugations with gentler slopes, and the sharper the angle at the vertex of each notch, the greater the pressure component. The pressure component can also be adjusted according to the height of the notches, particularly with the stiffness of the upper plate, namely the thrust pressure in the plane perpendicular to the sole.

According to one embodiment of this board, in at least one of the end zones of the upper plate, the latter is connected to the body by a layer of elastic material.

This layer of elastic material provides an intimate link while allowing sliding between the upper plate and the body. This, in addition, prevents formation of gaps into which the snow could penetrate.

It is also possible for the upper plate, in each free end zone, to be simply in contact with the body, with no intermediate mechanical link, the whole being covered by a protective cap preventing penetration of snow. Advantageously, in at least one of the end zones of the upper plate, the latter rests on the body, with a cap joined to the body covering at least part of this end zone of the upper plate and pressing through an elastic element against the upper face of the upper plate to ensure a contact pressure between the upper plate and the body of the board.

According to one embodiment, the upper plate extends into the middle part of the board, as well as in its front and/or rear zones, and is attached rigidly to the body only in the middle part of the board.

In this case, the upper plate is either placed above the body or built into the upper surface of the body.

According to one variant, the upper plate extends from a front or rear end zone of the board to the other rear or front end zone and is attached rigidly to the body at only one of these two end zones.

According to another embodiment, the upper plate is shorter and extends in the front and/or in the rear zone of the board, but not in the middle part thereof.

One sliding board may be equipped with several upper plates staggered lengthwise with respect to each other.

The length of the upper plate is between 0.2 and 0.9 times the length of the board.

The upper plate can extend across the entire width of the board or only part of its width.

According to one embodiment of this board, the upper plate is comprised of a core associated with at least one reinforcement bordered laterally by two reinforcing elements and covered by an upper wall.

According to another embodiment of this board, the upper plate is composed of a core associated with at least one reinforcement and bordered laterally and covered on its upper face by a shaped element in the form of a shell. In this case, the body of the board has a traditional design, while the upper plate is composed essentially of a shell.

BRIEF DESCRIPTION OF THE DRAWINGS

In any event, the invention will be thoroughly understood with the aid of the description hereinbelow with reference to the attached schematic drawings showing, as nonlimiting examples, several embodiments of this board, in the case of its application to a ski:

FIG. 2 is a perspective view of a ski according to the invention equipped with a boot binding;

FIG. 3 is a side view of the ski of FIG. 2;

FIG. 4 is a side view of detail D in FIG. 3;

FIGS. 5 and 6 are two views similar to FIG. 4 corresponding to two ski embodiments;

DETAILED DESCRIPTION OF PREFERRED EMBODIMENTS

Figure 1:
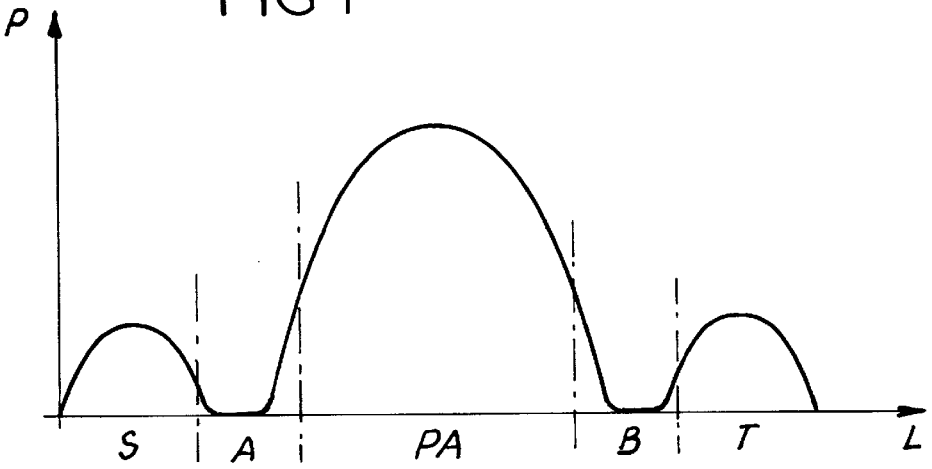
FIG. 1 is a view of a diagram showing distribution of the pressure of a ski, of a known type, on the snow as a function of its length.

FIG. 2 represents a ski 2 having a body 3 defining the length of the ski, and having in particular a tip 4 at the front end of the ski and a heel 5 at the rear end of the ski. On this body 3 rests an upper plate 6 extending up to the middle part or skating zone 7 of the ski, up to near the tip and heel zones. This upper plate 6 is equipped with a binding for a boot having a toe unit 8 and a heel unit 9. Upper plate 6 is attached rigidly to body 3 in skating zone 7. This rigid joint 10 is shown in the Figures by a dashed line. In the end zones, upper plate 6 is applied to body 3 elastically, with interposition of a layer 12 of elastic material. In the embodiment shown in FIGS. 2 to 4, the base of upper plate 6 has, near each of its ends, a downwardly projecting V-shaped nose 13 oriented transversely to the ski, while body 3 has a notch 14 of matching shape which nose 13 engages when the ski is in the resting position, i.e. not flexed.

Figure 6:
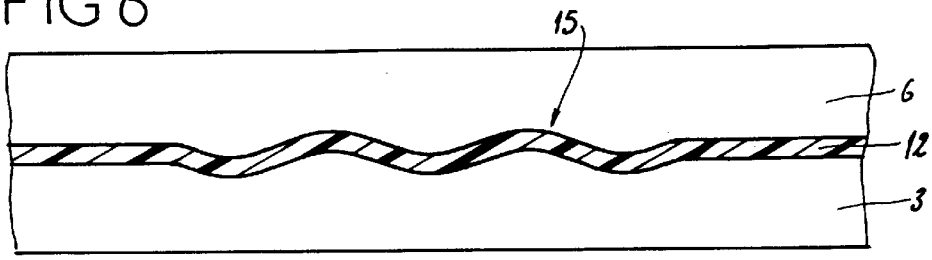

FIG. 5 shows a variant of this ski in which body 3 and the base of upper plate 6 each have a succession of matching noses and notches in a sawtooth shape. FIG. 6 shows a variant of the ski in FIG. 5, in which the noses are composed of corrugations 15 with a generally sinusoidal shape.

Figure 7:
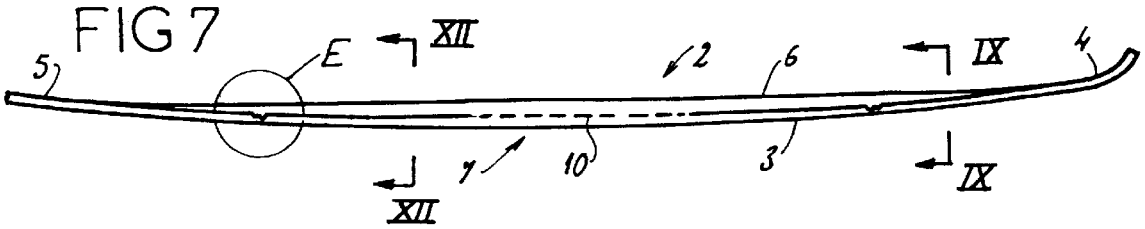
FIGS. 7 and 8 are two views corresponding respectively to FIGS. 3 and 4 of the flexed ski of FIG. 3.
Figure 8:
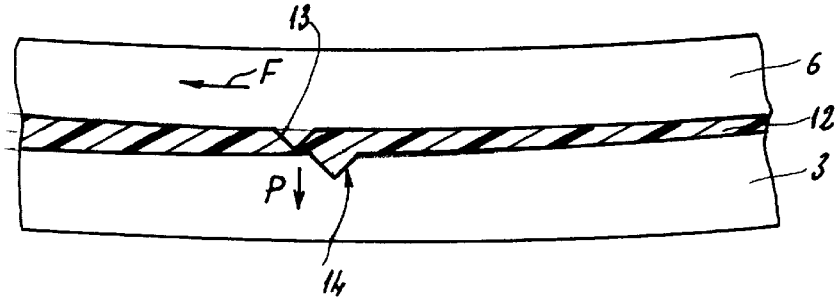

FIG. 7 illustrates ski 2 of FIGS. 2 and 3 in the flexed position. Detail E in FIG. 7, shown on an enlarged scale in FIG. 8, shows the relative displacement of upper plate 6 relative to body 3 when this flexing movement occurs. As a result, upper plate 6 tends to move toward the heel of the ski in the direction indicated by arrow F, thus applying a pressure P to body 3 through nose 13, said pressure force having a vertical component tending to exert a pressure on the snow.

Figure 17:
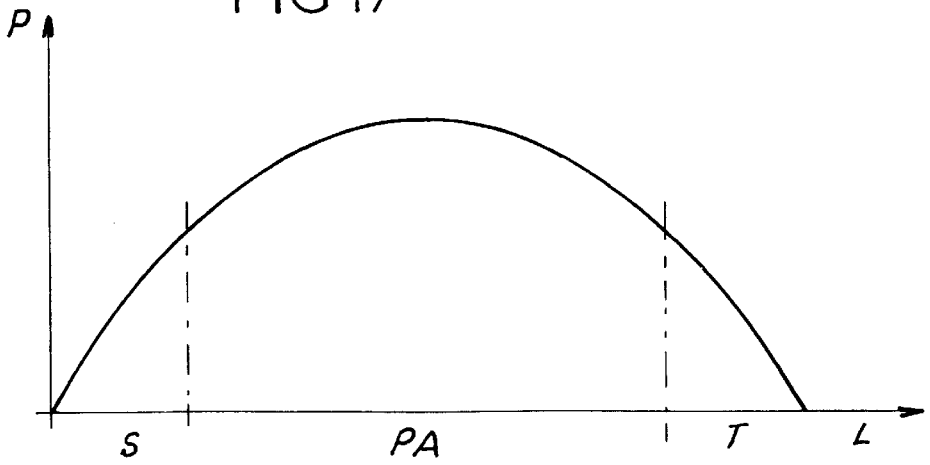
FIG. 17 is a view of a diagram similar to FIG. 1 showing the pressure applied by a ski to the snow as a function of its length, in the case of a ski according to the invention.

As a result, the curve of the ski pressure on the snow vs. position on the ski has the shape shown in FIG. 17, in which there is an improved continuity of the pressure between skating zone PA and tip zone S and heel zone T by comparison with a pressure curve characteristic of a known ski and shown in FIG. 1.

It is possible to modulate the pressure exerted by the upper plate taking into account its elasticity as well as the slopes and heights of the noses, and the elasticity of intermediate film 12.

Figure 9:
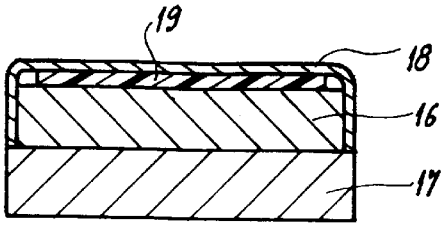
FIG. 9 is a schematic view in cross section along line IX—IX in FIG. 7 of a variant of an end zone of the ski in FIG. 2.

FIG. 9 shows a variant embodiment of a ski according to the invention. In this variant, an upper plate 16 rests on a body 17 without being joined to the body and without interposition of elastic material in at least one of its end zones. As shown in FIG. 9, upper plate 16 is narrower than body 17, and a cap 18, placed on body 17, covers upper plate 16 over at least part of the length of its end zone. Between the top wall of cap 18 and upper plate 16 is a layer of elastic material 19. This layer of elastic material could be replaced by a leaf spring for example. As a result of this design, elastic element 19, constrained by cap 18, ensures a contact pressure between upper plate 16 and body 17.

Figure 10:
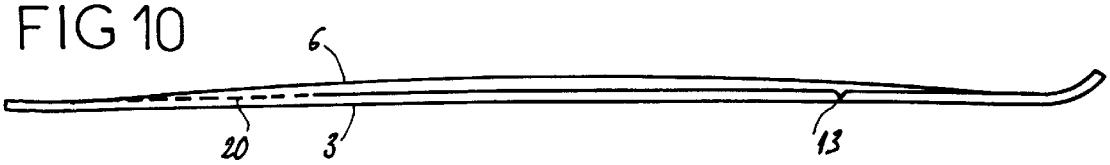
FIGS. 10 and 11 are two views similar to FIG. 3 of two other embodiments of skis according to the invention.

FIG. 10 shows a variant embodiment of the ski of FIG. 3, in which the same elements are given the same reference numerals as above. In this case, there is a rigid connecting zone 20 between upper plate 6 and body 3, in the rear end zone of the upper plate. Over the rest of its length, the upper plate is shown freely displaceable lengthwise on the body, with noses 13 in the front end zone, preferably with interposition of an elastic element 12, or mounting of a cap, as described with reference to FIG. 9, forming a lateral centering device for the plate relative to the ski body.

Figure 11:
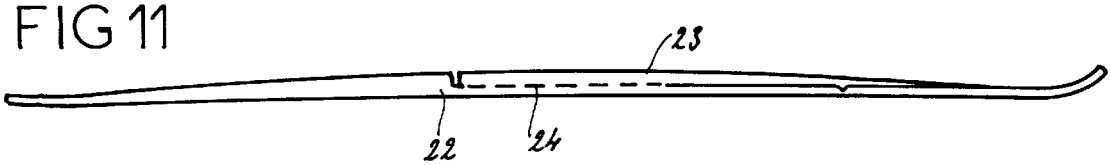

FIG. 11 represents another embodiment of a ski according to the invention in which body 22 supports an upper plate 23 which extends only from the middle part of the ski to the front zone thereof. In order to ensure continuity at the upper surface of the ski, body 22 has greater thickness in its rear part, this zone of greater thickness being extended in the middle part and in the front part of the ski by an overlapping zone, in which upper plate 23 is mounted. This upper plate 23 is rigidly attached at the skating zone 24, and is freely mounted on body 22 in the front part of the ski.

Figure 12:
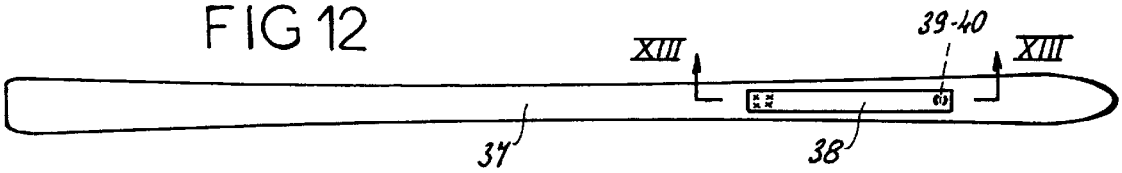
FIG. 12 is a top view of another ski.
Figure 13:
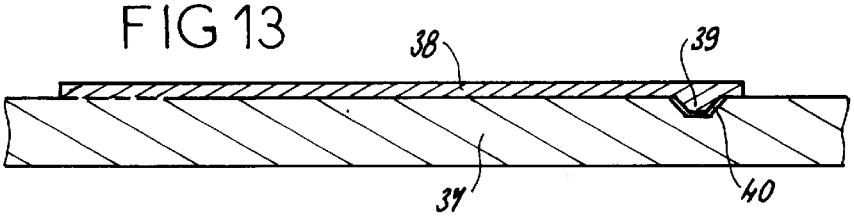
FIG. 13 is a partial view in lengthwise section along line XIII—XIII in FIG. 12.

FIG. 12 represents another ski in a top view. This ski has a body 37 on the upper face of which rests, in its front zone, an upper plate 38 that is narrower than the body. This plate is attached to the body by its rear end, while its front end rests on the body. This front end of plate 38 is equipped with a shaped finger 39 engaging a recess 40 provided in the upper surface of the body, as shown in FIG. 13.

Figure 14:
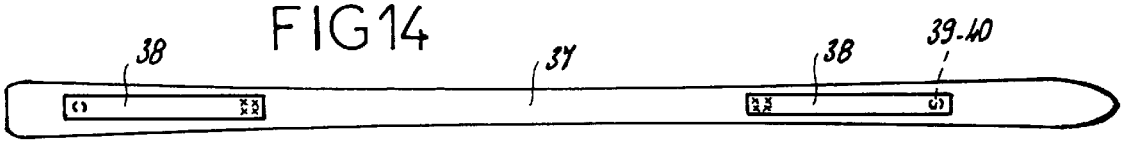
FIG. 14 is a view of a variant of the ski in FIG. 12.

FIG. 14 represents another ski equipped with two plates 38 resting on the same body 37, in the front and rear zones thereof.

Figure 15:
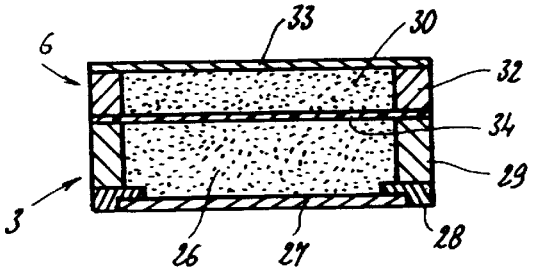
FIGS. 15 and 16 are two cross-sectional views of two skis according to the invention.

FIG. 15 shows a cross section through a first type of ski according to the invention. This ski has a body 3 composed of a core 26, the base of which rests on a sole 27 bordered by two lengthwise edges 28. The side walls of core 26 are covered with side pieces 29 resting on edges 28. Upper plate 6 is composed of a core 30, whose side walls are covered by upper side pieces 32 and whose upper face is covered by an upper wall 33. Where the cross section in FIG. 15 is through an end zone, a layer of elastic material 34 is interposed between body 3 and upper plate 6. This FIG. 15 does not represent the reinforcing elements that the ski may have either on body 3 or on upper plate 6.

Figure 16:
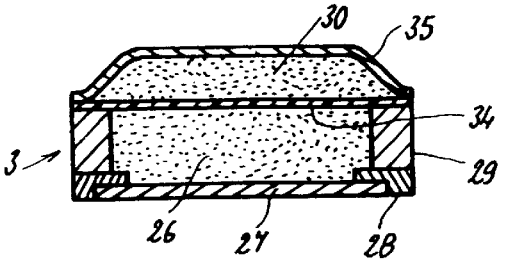

FIG. 16 is a variant embodiment of the ski in FIG. 15. In this ski, body 3 has the same structure and the same elements are designated by the same numerals as above. The upper plate, for its part, has an upper wall and side walls composed of a shell 35, whose edges rests on lower side pieces 29 of body 3.

It goes without saying that the invention is not confined to the embodiments of this ski described hereinabove as examples, but on the contrary includes all variants thereof.

What is claimed is:

1. A board for sliding on snow, the board comprising:

an elongate body having a tip and a heel at opposing ends, and middle, front and rear zones disposed between the tip and heel zones, the body comprising:

a sole, lengthwise strips bordering the sole, a core disposed on the sole, side walls bordering the sides of the core, and at least one reinforcing element; and at least one elongate upper plate overlaying the body and having front, middle and rear portions, wherein one of the front, middle and rear portions of the upper plate is rigidly attached to one of the middle, front and rear zones, wherein one of an indentation and a projection is formed on a portion of the upper plate that is oriented transversely relative to a longitudinal axis of the board and is not rigidly attached to the body, and wherein the other of the indentation and projection is formed on an abutting portion of the body and is also oriented transversely relative to the longitudinal axis of the board so that the indentation mates with the projection when the body is in a relaxed state such that the upper plate is displaced longitudinally toward the heel relative to the body and the indentation and the projection each oppose the longitudinal displacement of the upper plate during a flexed movement of the board, thereby transforming the longitudinal displacement of the upper body into a pressure force component exerted to the snow in a direction perpendicular relative to the sole.

2. The board of claim 1, wherein the at least one reinforcing element comprises at least one of a metal plate, a fabric layer and a metal strip.

3. The board of claim 1, wherein the projection comprises a transverse bar and the indentation comprises a transverse groove.

4. The board of claim 1, wherein the projection comprises a finger and the indentation comprises a depression having a shape that matches the finger.

5. The board of claim 1, wherein a plurality of projections are formed on the front and rear portions of the upper plate.

6. The board of claim 1, further comprising an elastic material layer connecting at least one of the front and rear portions of the upper plate to the body.

7. The board of claim 1, further comprising:

a cap attached to the body and covering at least part of the upper plate; and an elastic element disposed between the cap and the upper plate.

8. The board of claim 1, wherein the upper plate overlays the middle, front and rear zones of the body, and wherein the upper plate is attached to the middle zone of the body.

9. The board of claim 1, wherein the upper plate overlays the middle, front and rear zones of the body and wherein the upper plate is attached to one of the front and rear zones of the body.

10. The board of claim 1, wherein the upper plate overlays one of the front and rear zones of the body.

11. The board of claim 1, wherein the at least one upper plate comprises first and second upper plates, and wherein the first upper plate overlays one of the front and rear zones of the body and the second upper plate overlays the other of the front and rear zones of the body.

12. The board of claim 1, wherein a length of the upper plate is between approximately 0.2 and 0.9 times a length of the board.

13. The board of claim 1, wherein the at least one upper plate comprises a first and second upper plates, and wherein the first and second upper plates are staggered lengthwise along the body.

14. The board of claim 1, wherein the at least one upper plate comprises:

an upper plate core;

two upper side walls laterally bordering the upper plate core; and an upper wall covering the upper plate core.

15. The board of claim 1, wherein the at least one upper plate comprises:

an upper plate core; and an upper plate shell that borders sides of the upper plate core and that covers an upper face of the upper plate core.

16. The board of claim 3, wherein the board comprises a plurality of transverse bars that engage a corresponding plurality of transverse grooves to produce a sawtooth shape.

17. The board of claim 3, wherein the transverse bar and transverse groove produce a corrugated shape.

18. The board of claim 3, wherein longitudinal axes of the bar and transverse groove extend in a direction perpendicular to a longitudinal axis of the board.

* * * * *